US006586900B2

(12) United States Patent
Rider et al.

(10) Patent No.: US 6,586,900 B2
(45) Date of Patent: Jul. 1, 2003

(54) METHOD FOR BOOSTING THE OUTPUT VOLTAGE OF A VARIABLE FREQUENCY DRIVE

(75) Inventors: Jerald R. Rider, Catoosa, OK (US); James E. Layton, Chelsea, OK (US); John M. Leuthen, Claremore, OK (US); Dick L. Knox, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 7 days.

(21) Appl. No.: 09/853,531

(22) Filed: May 11, 2001

(65) Prior Publication Data

US 2001/0032721 A1 Oct. 25, 2001

Related U.S. Application Data

(63) Continuation-in-part of application No. 09/029,732, filed on Feb. 8, 1999, now Pat. No. 6,167,965.

(60) Provisional application No. 60/203,792, filed on May 12, 2000, and provisional application No. 60/204,818, filed on May 17, 2000.

(51) Int. Cl.[7] ..... H02M 5/06

(52) U.S. Cl. ..... 318/459; 318/500; 363/74

(58) Field of Search ..... 318/801, 459, 318/500; 363/27, 28, 37, 40, 78, 79, 80, 131, 133, 134, 74

(56) References Cited

U.S. PATENT DOCUMENTS

| | | | | | |
|---|---|---|---|---|---|
| 4,138,715 | A | * | 2/1979 | Miller | 363/28 |
| 4,196,469 | A | * | 4/1980 | Gurwicz | 363/131 |
| 4,413,313 | A | * | 11/1983 | Robinson | 363/80 |
| 4,541,041 | A | | 9/1985 | Park et al. | 363/41 |
| 4,574,342 | A | * | 3/1986 | Runyan | 363/134 |
| 4,833,584 | A | * | 5/1989 | Divan | 363/37 |
| 4,862,342 | A | * | 8/1989 | Dhyanchand et al. | 363/40 |
| 4,928,771 | A | | 5/1990 | Vandevier | 166/385 |
| 5,208,738 | A | | 5/1993 | Jain | 363/17 |
| 5,844,397 | A | | 12/1998 | Konecny et al. | 318/811 |
| 5,909,098 | A | | 6/1999 | Konecny et al. | 318/811 |
| 5,930,131 | A | | 7/1999 | Feng | 363/56 |
| 6,135,732 | A | | 10/2000 | Angorin | 417/423.3 |

FOREIGN PATENT DOCUMENTS

EP 0 413 514 2/1991

OTHER PUBLICATIONS

"A Zero–Current–Siwtching Based Three–Phase PWM Inverter Having Resonant Circuits on AC–Side," H. Akagi and M. Kohata, Okayama University, Toyo Electric Mfg. Co. Ltd., 1993 IEEE Industry App conference, Twenty–Eighth IAS Annual Meeting, pp. 821–826.

"Design and Implementation of an Inverter Output LC Filter Used for DV/DT Reduction," by Thomas Rajendra Naik and Thomas A. Nondahl, 1999 Fourteenth Annual Applied Power Electronics Conference Exposition, IEEE, vol. 2, Mar. 14, 1999, pp. 1279–1284.

* cited by examiner

*Primary Examiner*—Bentsu Ro

(57) ABSTRACT

A sine wave filter including an inductor for each phase (three inductors) and three delta- or Y-connected capacitors is employed within a borehole power system, coupled within a three phase power system at the surface between the output of a variable frequency drive and a three phase power cable transmitting power to a borehole location, and boosts the output voltage of the drive. The sine wave filter is designed to have a resonant frequency higher than the maximum operational frequency of the drive, and a Q such that, at the maximum operational frequency of the drive, the filter provides a voltage gain equal to the ratio of the desired voltage to the drive's maximum output power at the maximum operational frequency. The sine wave filter also smooths the voltage waveform of a pulse width modulated variable frequency drive.

20 Claims, 1 Drawing Sheet

METHOD FOR BOOSTING THE OUTPUT VOLTAGE OF A VARIABLE FREQUENCY DRIVE

CROSS-REFERENCE TO RELATED APPLICATIONS

The present application is related to the subject matter disclosed in: U.S. provisional applications serial Nos. 60/203,792 and 60/204,818, filed May 12, 2000 and May 17, 2000, respectively (priority to those provisional applications is claimed under 35 U.S.C. §119(e) (1)); and, as a continuation-in-part of, U.S. application Ser. No. 09/029,732 Filed on Feb. 8, 1999 entitled ELECTRICAL SUBMERSIBLE PUMP AND METHODS FOR ENHANCED UTILIZATION OF ELECTRICAL SUBMERSIBLE PUMPS IN THE COMPLETION AND PRODUCTION OF WELLBORES, now U.S. Pat. No. 6,167,965. The content of the above-identified applications is incorporated herein by reference.

TECHNICAL FIELD OF THE INVENTION

The present invention is directed, in general, to power systems for subterranean bore hole equipment and, more specifically, to boosting the output of variable frequency drives employed to power electrical submersible pumps within well bores.

BACKGROUND OF THE INVENTION

Electrical power is frequently transmitted to subterranean locations within boreholes to power downhole equipment, such as electrical submersible pumps (ESPs). Normally three phase electrical power is transmitted from the surface over cables running between the well casing and the production tubing.

In some downhole applications, high voltage electrical power is required. For example, electrical motors for ESPs may require voltages of 1,000 to 5,000 volts at the surface. However, electrical drives capable of providing output voltages at the required level may not be available, or may not be economical even when available. When lower output voltage drives are employed in such situations, typically step-up transformers at the output of the drive are utilized to boost the voltage of power transmitted downhole. Step-up transformers add to the expense of the system, however, and add additional sources of failure or disturbance to the electrical system.

There is, therefore, a need in the art for a system allowing an electric drive having a maximum output voltage lower than required to be utilized to power downhole equipment while eliminating the need for step-up transformers. It would further be advantageous to smooth the output of a pulse width modulated variable frequency drive while boosting the output voltage.

SUMMARY OF THE INVENTION

To address the above-discussed deficiencies of the prior art, it is a primary object of the present invention to provide, for use in powering downhole equipment, a sine wave filter including an inductor for each phase (three inductors) and three delta- or Y-connected capacitors. The sine wave filter is coupled within a three phase power system at the surface, between the output of a variable frequency drive and a three phase power cable transmitting power to a borehole location to boost the output voltage of the drive. The sine wave filter is designed to have a resonant frequency higher than the maximum operational frequency of the drive, and a Q such that, at the maximum operational frequency of the drive, the filter provides a voltage gain equal to the ratio of the desired voltage to the drive's maximum output power at the maximum operational frequency. The sine wave filter also smooths the voltage waveform of a pulse width modulated variable frequency drive.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

Figure 1:
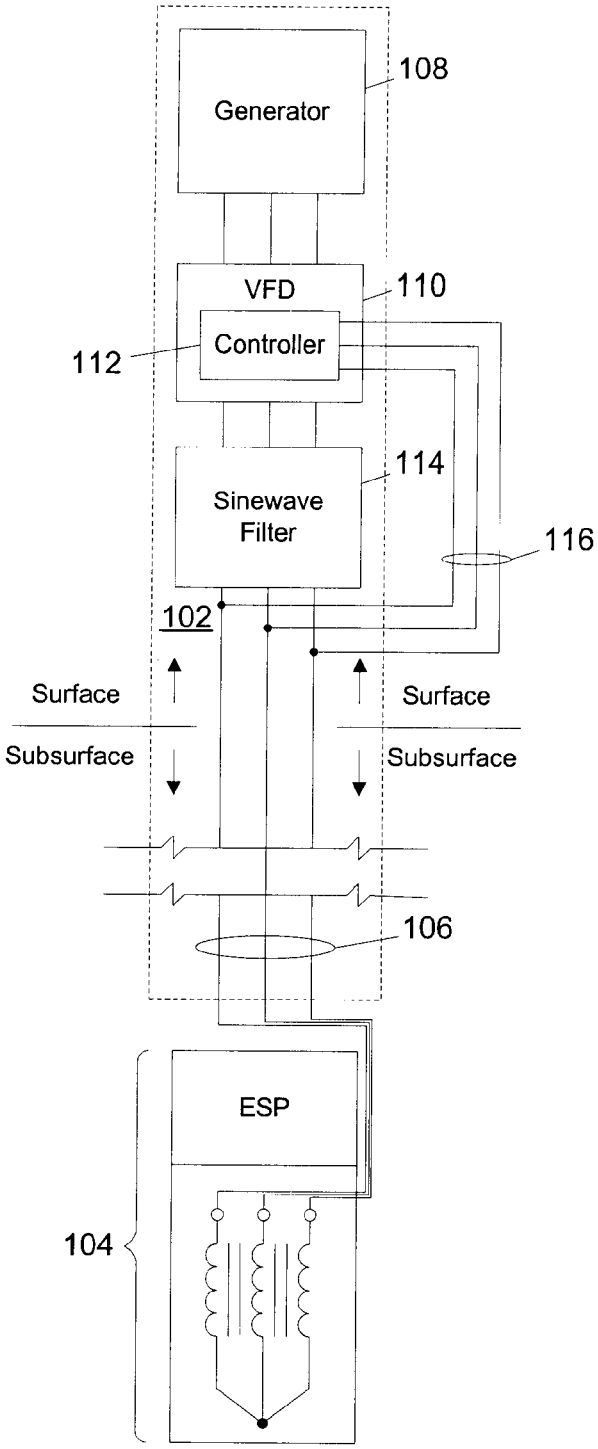
FIG. 1 depicts a three phase electrical power system employed to power downhole equipment according to one embodiment of the present invention.
Figure 2A:
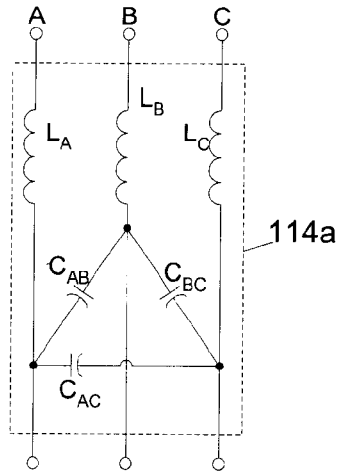
FIGS. 2A–2B illustrate in greater detail circuit diagrams for sine wave filters employed within a three phase electrical power system for downhole equipment according to one embodiment of the present invention.
Figure 2B:
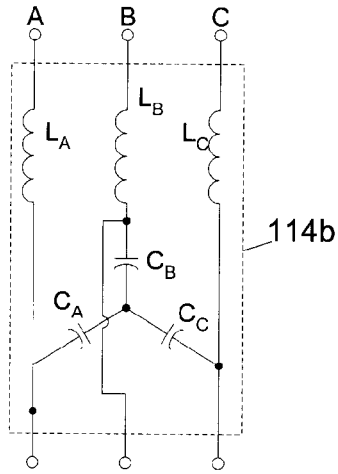
Figure 3:
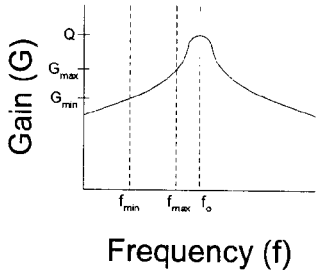
FIG. 3 depicts a plot of gain versus frequency for a sine wave filter employed within a three phase electrical power system according to one embodiment of the present invention.

FIGS. 1 through 3, discussed below, and the various embodiment used to describe the principles of the present invention in this patent document are by way of illustration only and should not be construed in any way to limit the scope of the invention. Those skilled in the art will understand that the principles of the present invention may be implemented in any suitably arranged device.

FIG. 1 depicts a three phase electrical power system employed to power downhole equipment according to one embodiment of the present invention. The electrical power system 102 located at the surface of a borehole is coupled to a motor and pump 104 adapted for use within a borehole and disposed within the borehole by connection to tubing lowered within the well casing. Motor and pump assembly 104 includes an electrical submersible pump (ESP) in the exemplary embodiment, which may be of the type disclosed in U.S. Pat. No. 5,845,709, coupled to an induction motor. The induction motor drives the ESP and is powered by three phase power transmitted over three phase transmission cable 106 electrically coupling motor and pump assembly 104 to a surface power system including generator 108 and drive 110.

Three phase transmission cable 106 include separate conductors for each electrical power phase and transmits power from the surface power system including generator 108, which produces three phase power, coupled to variable frequency drive (VFD) 110, designed to provide the appropriate voltage waveform at a selected frequency within a defined operating frequency range for powering motor and pump assembly 104. In the exemplary embodiment variable frequency drive 110 is a pulse width modulated (PWM) drive operationally regulated by a controller 112. Controller 112 for drive 110 changes the output frequency of drive 110 by altering the width of pulses forming the output voltage in accordance with the known art. Other suitable existing power electronics inverters may be employed for drive 110.

In the present invention, drive 110 may have a maximum output voltage (anywhere within the operating frequency range) which is lower than a voltage required for powering motor and pump assembly 104 disposed within the borehole. Drive 110 may be a low voltage drive having a maximum output voltage of only 480 volts (V), for example, while motor and pump assembly 104 may include a medium voltage motor requiring 1,000 V to 4,000 V at the surface. (Surface voltages are referenced since the cable 106, which may be thousands of feet long, will cause significant attenuation between the surface voltage and the voltage at the motor downhole.) Alternatively, drive 110 may have a maximum output voltage of 4,160 V, while a surface voltage of 5,000 V is requires to power motor and pump assembly 104. To boost the output voltage of drive 110, a sine wave filter 114 is coupled within the three phase power system 102 between the output of drive 110 and three phase cable 106 carrying power into the borehole.

While the sine wave filter 114 is preferably located at the surface, alternatively the sine wave filter may located downhole proximate to the motor, in which case the parameters of interest are the received input voltage at the input of the sine wave filter 114 received from the surface and the required motor voltage.

FIGS. 2A and 2B illustrate in greater detail circuit diagrams for sine wave filters employed within a three phase electrical power system for downhole equipment according to one embodiment of the present invention. Sine wave filter 114*a* depicted in FIG. 2A includes three inductors $L_A$, $L_B$, and $L_C$ each serially connected within a phase A, B and C, respectively, of the three phase power system between the output of the variable frequency drive and the three phase power cable 106 transmitting the power downhole. Sine wave filter 114*a* also includes three delta-connected capacitors $C_{AB}$, $C_{BC}$, and $C_{AC}$ between phases A and B, between phases B and C, and between phases A and C, respectively, of the three phase power system.

Sine wave filter 114*a* depicted in FIG. 2B also includes three inductors $L_A$, $L_B$, and $L_C$ each serially connected within a phase A, B and C, respectively, of the three phase power system, but contains three Y-connected capacitors $C_A$, $C_B$, and $C_C$ connected within phases A, B and C of the three phase power system, between the respectively phase and a common or neutral point.

In either implementation (114*a* in FIG. 2A or 114*b* in FIG. 2B), inductors $L_A$, $L_B$, and $L_C$ each have the same inductance L, and either capacitors $C_{AB}$, $C_{BC}$, and $C_{AC}$ or capacitors $C_A$, $C_B$, and $C_C$ each have the same capacitance C (although the capacitance C of, for example, $C_A$ is not necessarily the same as capacitance C of $C_{AB}$). The inductance L and capacitance C are selected to provide a filter voltage gain for three phase power at a maximum operational frequency of the variable frequency drive which is preferably equal to the ratio of the desired voltage for powering downhole equipment to the maximum output voltage of the drive.

FIG. 3 depicts a plot of gain versus frequency for a sine wave filter employed within a three phase electrical power system according to one embodiment of the present invention. The sine wave filter 114*a* or 114*b* is tuned to have a resonant frequency $f_0$ which is offset from (higher than) the maximum operational frequency $f_{max}$ of the variable frequency drive. The resonant frequency of the filter may be determined from:

$$f_0 = \frac{1}{2\pi\sqrt{3LC}}. \tag{1}$$

The sine wave filter is also designed to have a quality factor Q, when excited by three phase power, which is greater than one. The quality factor Q may be determined from:

$$Q = \frac{3(2\pi)f_0 L}{R}, \tag{2}$$

where R is the resistance of the sine wave filter components. The sine wave filter quality Q represents the gain of the filter at resonance, and thus the sine wave filter is capable of boosting the output voltage of the variable frequency drive by a factor equal to—or nearly equal to—the filter Q at the resonant frequency.

Because the drive frequency changes, however, it is not desirable to match the resonant frequency of the sine wave filter to the maximum operational frequency of the variable frequency drive. The high Q required to minimize filter losses under such circumstances would provide too much gain at the maximum operating frequency. Also, operating very close to the peak of the filter's resonance frequency would place operations on a very steep part of the filter's gain curve (gain plotted as a function of frequency, illustrated in FIG. 3), making voltage regulation difficult.

Therefore, the sine wave filter is designed to have a resonant frequency offset from (and preferably higher than) maximum operating frequency of the variable frequency drive, on a portion of the frequency-dependent gain curve for the filter which is sufficiently gradual to permit voltage regulation (i.e., preferably within the range of voltage variances supported by the drive).

For example, if the maximum operational frequency of the variable frequency drive is 80 Hertz (Hz), the sine wave filter may be tuned to have a resonant frequency within the range of 90 Hz to 200 Hz, or more likely within the range of 90 Hz to 120 Hz. The filter is preferably always tuned for a resonant frequency higher than the drive's maximum operating frequency due to the need for a positive volts-per-Hertz ratio.

Since the gain G will vary with the frequency of the three phase power exciting the sine wave filter, the filter is preferably designed to provide a maximum gain $G_{max}$ at the maximum operating frequency $f_{max}$ of the drive. The maximum gain $G_{max}$ is preferably equal to the ratio of the desired or required (surface) voltage to the maximum output voltage of the drive. In one of the examples described above, the sine wave filter would be designed to have a gain at the maximum operational frequency of the drive (e.g., 80 Hz) equal to 5,000/4,160, or about 1.2. In embodiments in which the filter resonant frequency is higher than the maximum operating frequency of the sine wave filter, the sine wave filter 114 will also have a minimum gain $G_{min}$ at the minimum operational frequency $f_{min}$ of the drive. It would be desirable, but is not necessary, for the minimum gain $G_{min}$ to be greater than one.

The inductances and capacitances required to obtain a desired resonant frequency $f_0$, and/or maximum gain $G_{max}$ at the maximum operating frequency $f_{max}$ of a particular generator/drive configuration, for the sine wave filter 114, may be determined utilizing existing electrical simulation programs.

Referring back to FIG. 1, when excited by the output of drive 110 (utilizing power received from generator 108) filter 114 will (at least partially) resonate at the output frequency of drive 110, thus increasing the output voltage of filter 114 over the output voltage of drive 114 by a factor equal to the gain G of the filter 114 at the output frequency of drive 110. By tuning filter 114 to a resonant frequency above the maximum output frequency $f_{max}$ of drive 110, the voltage boost provided by filter 114 will follow the output frequency of drive 110. In operation of electrical power system 102, the output voltage of filter 114 is connected by feedback loop 116 to controller 112. Controller 112 may thus monitor and regulate the output voltage of filter 114, altering the output voltage of filter 114 by controlling the output voltage and/or the output frequency of drive 110.

For a pulse width modulated variable frequency drive, sine wave filter 114 has the additional benefit of smoothing the voltage output of drive 110 into a very sinusoidal signal. For electrical submersible pumps, such smoothing of the power signal prevent problems from resonant frequencies and reflected waves, in addition to boosting the output voltage of the drive 110.

Although one or more embodiments of the present invention have been described in detail, those skilled in the art will understand that various changes, substitutions and alterations herein may be made without departing from the spirit and scope of the invention it its broadest form.

What is claimed is:

1. For use in a downhole power system, an electrical power system for a motor within a wellbore comprising:

a power electronics inverter selectively producing an output voltage at an output, the output voltage lower than a required voltage for powering the motor within the wellbore; and a resonant circuit adapted for selective connection to the output of the inverter, wherein the resonant circuit, when connected to the output of the inverter and excited by the output voltage, boosts the output voltage towards the required voltage at an output of the resonant circuit.

2. The electrical power system as set forth in claim 1 wherein the resonant circuit boosts the output voltage to the required voltage.

3. The electrical power system as set forth in claim 2 wherein the resonant circuit further comprises:

an inductive-capacitive filter having a resonant frequency offset from a maximum operating frequency of the inverter, the filter having a gain at the maximum operating frequency of the inverter approximately equal to the required voltage divided by the output voltage.

4. The electrical power system as set forth in claim 3 wherein the filter further comprises:

an inductance serially connected in each phase of a three phase power transmission system coupled to the inverter; and capacitances connected between phases of the three phase power transmission system.

5. The electrical power system as set forth in claim 1 further comprising:

a feedback connection from an output of the resonant circuit to the inverter, the feedback connection allowing the inverter to regulate an output voltage of the resonant circuit.

6. The electrical power system as set forth in claim 1 wherein a frequency dependent gain curve of the resonant circuit is sufficiently gradual across an operating frequency range of the inverter to permit voltage regulation over the operating frequency range.

7. The electrical power system as set forth in claim 1 wherein a frequency dependent gain curve of the resonant circuit exhibits a maximum gain at a maximum operating frequency of the inverter and a minimum gain at a minimum operating frequency of the inverter.

8. A borehole electrical system, comprising:

a pump within the wellbore;

a motor within the wellbore, the motor selectively driving the pump; and an electrical power system for powering the motor, the electrical power system comprising:

a generator and a power electronics inverter located at a surface region proximate the wellbore, the generator and the inverter selectively producing an output voltage at an output, the output voltage lower than a required voltage for powering the motor; and a resonant circuit connected to the output of the inverter, the resonant circuit boosting the output voltage towards the required voltage at an output of the resonant circuit.

9. The borehole electrical system as set forth in claim 8 wherein the resonant circuit boosts the output voltage to the required voltage.

10. The borehole electrical system as set forth in claim 9 wherein the resonant circuit further comprises:

an inductive-capacitive filter having a resonant frequency offset from a maximum operating frequency of the inverter, the filter having a gain at the maximum operating frequency of the inverter approximately equal to the required voltage divided by the output voltage.

11. The borehole electrical system as set forth in claim 10 wherein the filter further comprises:

an inductance serially connected in each phase of a three phase power transmission system coupled to the inverter; and capacitances connected between phases of the three phase power transmission system.

12. The borehole electrical system as set forth in claim 8 further comprising:

a feedback connection from an output of the resonant circuit to the inverter, the feedback connection allowing the inverter to regulate an output voltage of the resonant circuit.

13. The borehole electrical system as set forth in claim 8 wherein a frequency dependent gain curve of the resonant circuit is sufficiently gradual across an operating frequency range of the inverter to permit voltage regulation over the operating frequency range.

14. The borehole electrical system as set forth in claim 8 wherein a frequency dependent gain curve of the resonant circuit exhibits a maximum gain at a maximum operating frequency of the inverter and a minimum gain at a minimum operating frequency of the inverter.

15. For use in a borehole electrical system, a method of powering a downhole motor comprising:

producing an output voltage at an output of a power electronics inverter which is lower than a required voltage; and boosting the output voltage towards the required voltage utilizing a resonant circuit connected to the output of the inverter.

16. The method as set forth in claim 15 wherein the step of boosting the output voltage towards the required voltage utilizing a resonant circuit connected to the output of the inverter further comprises:

boosting the output voltage to the required voltage.

17. The method as set forth in claim 16 wherein the step of boosting the output voltage towards the required voltage utilizing a resonant circuit connected to the output of the inverter further comprises:

connecting an inductive-capacitive filter having a resonant frequency offset from a maximum operating frequency of the inverter to the output of the inverter, the filter having a gain at the maximum operating frequency of the inverter approximately equal to the required voltage divided by the output voltage.

18. The method as set forth in claim 17 wherein the step of connecting a filter having a resonant frequency offset from a maximum operating frequency of the inverter to the output of the inverter further comprises:

serially connecting an inductance in each phase of a three phase power transmission system coupled to the inverter; and connecting capacitances between phases of the three phase power transmission system.

19. The method as set forth in claim 15 further comprising:

providing a feedback connection from an output of the resonant circuit to the inverter, the feedback connection allowing the inverter to regulate an output voltage of the resonant circuit.

20. The method as set forth in claim 15 wherein the step of boosting the output voltage towards the required voltage utilizing a resonant circuit connected to the output of the inverter further comprises:

boosting the output voltage utilizing a resonant circuit having a frequency dependent gain curve which is sufficiently gradual across an operating frequency range of the inverter to permit voltage regulation over the operating frequency range.

* * * * *